United States Patent [19]

Gordon et al.

[11] 4,417,495

[45] Nov. 29, 1983

[54] WEB DISPENSER

[75] Inventors: Marc J. Gordon, Boston, Mass.; Stanley Ruff, New Rochelle, N.Y.

[73] Assignee: RGG, Inc., Boston, Mass.

[21] Appl. No.: 348,515

[22] Filed: Feb. 12, 1982

[51] Int. Cl.[3] ..... B26D 7/14; A47K 10/36

[52] U.S. Cl. ..... 83/175; 83/649; 83/37; 225/43; 225/93

[58] Field of Search ..... 83/649, 455, 610, 456, 83/175, 37; 225/43, 93

[56] References Cited

U.S. PATENT DOCUMENTS

| | | | |
|---|---|---|---|
| 3,311,278 | 3/1967 | Brandon | 83/649 X |
| 3,803,963 | 4/1974 | Hunt | 83/175 X |
| 4,196,647 | 4/1980 | Fish | 83/175 |

*Primary Examiner*—Donald R. Schran

*Attorney, Agent, or Firm*—Cesari and McKenna

[57] ABSTRACT

A dispenser for serving and severing web from a roll includes a container for supporting the roll and a slotted cutting shelf over which web from the roll is draped. A swing-down cover hinged to the container carries a knife blade aligned with the shelf slot and a retractable sheath which envelops the blade until the dispenser is operated to sever the web. The sheath is an elongated flexible resilient member which is downwardly bowed so that, when the cover is swung toward its closed position, the sheath engages the web on the shelf at the midportion of the web first and then gradually engages web portions outboard from that midportion in a progressive fashion by a rolling clamping action until the entire length of the sheath is flexed flat against the web on the shelf thereby laterally tensioning the web as the blade edge projects through the web into the shelf slot.

12 Claims, 7 Drawing Figures

WEB DISPENSER

This invention relates to a web dispenser. It relates more especially to a dispenser which facilitates the serving and cutting of lengths of web and particularly limp film.

BACKGROUND OF THE INVENTION

The utilization of sheet material such as wax paper, metal foil and film to wrap various products, particularly food products, has burgeoned in recent years. The web is most usually wound in a roll which is rotatively positioned in a box or other container. The box is equipped with a cutter edge so that a selected length of material can be drawn from the roll and tensioned over the cutter edge and torn to separate that selected length of material from the remainder of the roll.

There also exist web and sheet material dispensers which incorporate knife blades or cutters to facilitate separating a drawn length of material from the rest of the roll. Dispensers such as this are especially useful to dispense very thin limp film such as the film marketed by Dow Chemical Co. under its trademark Saran. Examples of dispensers of this general type are described in U.S. Pat. Nos. 3,311,278 and 3,419,201. Cutter devices have also been designed to attach to a standard carton containing such web so that the web can be served and cut right from its original carton. An example of such a device is disclosed in U.S. Pat. No. 4,196,647.

While these prior dispensers do serve and sever web, even limp film, reasonably satisfactorily, they have certain drawbacks. More particularly, some people find the dispensers typified by the ones depicted in the first two aforementioned patents fairly difficult to use. This is because, after a length of web is severed by the dispenser's cutter mechanism, the new leading edge of the film is relatively inaccessible. Therefore, it is difficult for some to grip that edge in order to pull additional material from the roll. The problem is particularly acute when dispensing very thin films which possess a considerable charge of static electricity and which therefore tend to cling. As soon as a length of film is severed, the new leading edge margin of the film tends to fly back and cling against the remainder of the roll so that it is relatively difficult for some users to grasp that edge.

Further, conventional dispensers of this general type do not invariably sever the web across its entire width, particularly if the web is a very thin limp film. The cutter mechanisms in the prior apparatus may leave portions of the drawn segment attached to the remainder of the roll so that, when the drawn segment is pulled away from the cutter, unwanted material is unwound from the roll. The user must then try to tear the partially severed segment away from that additional material whereupon that segment and the unwanted material tend to cling to themselves and to the dispenser housing.

Also some prior dispensers are relatively complicated structures, being composed of a number of small parts which must be made separately and assembled by hand in order to form the finished dispenser. Consequently, the prior products which have been available to data have proven to be more expensive than they ought to be.

On the other hand, the cutter parts depicted in the last above-mentioned patent have to be assembled by the housewife on the standard cardboard box containing the web roll. Some find that difficult to do. Also, the separate parts may become lost and the cutting blade is exposed and presents a hazard. Still further, after repeated usage the cardboard carton tends to tear, rendering the cutter mechanism unable to perform its cutting and serving functions.

SUMMARY OF THE INVENTION

Accordingly, the present invention aims to provide an improved dispenser for dispensing sheet material from a roll, particularly limp film having considerable cling.

Another object of the invention is to provide a dispenser of this type which is relatively inexpensive to manufacture.

A further object of the invention is to provide a film dispenser which serves and severs the web in a very reliable fashion.

Yet another object of the invention is to provide a web dispenser which is quite easy to use and which, in fact, can be operated with only one hand.

Still another object of the invention is to provide a web dispenser of this general type which is safe to use.

Another object of the invention is to provide such a dispenser which can dispense sheet material from different size rolls.

A further object of the invention is to provide a dispenser such as this which always maintains the new leading edge of the web at a readily accessible location in the dispenser.

A further object of the invention is to provide such a dispenser which is quite small and compact and composed of a minimum number of easily assembled parts.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

In general, the present dispenser comprises a generally rectangular open-topped container or box having a swing-down cover hinged to the upper edge of its rear wall. The cover has a stable open position wherein it is oriented at an angle with respect to the plane of the opening into the container. In some applications, the cover may be spring-biased to an open position.

A roll of web material such as thin film is rotatively supported in a trough within the container so that the web can be drawn preferably from the underside of the roll over the forward edge of the container. A cutting shelf or ledge is formed at that edge over which the drawn web is draped to facilitate cutting the web. The shelf is formed with a lengthwise slot and functions as the knife back-up or anvil. Also, the shelf surfaces on opposite sides of the slot are treated so that they grip the web on opposite sides of the slot.

The actual cutting assembly or mechanism is situated in the cover adjacent the leading edge thereof. It comprises a long sharp knife, preferably having a serrated edge. The knife is surrounded by a special retractable sheath so that, when the cover is in its raised position, the cutting edge of the knife is recessed in the sheath so that it does not present a danger to the user.

While the knife itself has a straight cutting edge which is parallel to the shelf formed in the container, the sheath comprises an elongated flexible resilient slotted member which is retractably supported at its opposite ends by the cover so that, when extended, it surrounds the knife edge. Furthermore, the sheath is bowed downwardly so that the midportion of the unstressed sheath extends downward toward the container shelf further than its ends.

To use the dispenser, one draws the leading edge of the web across the shelf until the desired length of web is pulled from the roll. When the cover is open, the user can readily grasp the leading edge margin of the web which normally rests on the rear edge margin of the container shelf. The drawn tensioned web engages the shelf surfaces on opposite sides of the shelf slot. Then one swings down the dispenser cover towards its closed position by pressing down on the cover.

Since the retractable knife sheath is bowed as noted above, the midsection of that sheath engages the container shelf thereby sandwiching the midsection of the web between the sheath and the treated shelf surface on opposite sides of the shelf slot. The container shelf is angled downwardly and rearwardly so that, when the cover swings down, the surfaces of the sheath on opposite sides of the sheath slot are pressed flush against the shelf surfaces, thereby firmly gripping the midsection of the web between the shelf surfaces on opposite sides of the shelf slot.

As the cover is passed further toward its fully closed position, the flexible resilient sheath is flexed so that lengthwise surface portions thereof outboard from the sheath center line progressably engage the shelf or, more particularly, the web thereon until ultimately the sheath is flexed to a substantially straight condition so that its entire length is pressed flush against the web on the shelf. Also, when the knife is in that condition, the web is gripped tightly on opposite sides of the sheath and shelf slots and the web that spans those slots is under a relatively high lateral as well as longitudinal tension when it is contacted by the knife edge. Consequently, the knife edge and more particularly the points of its serrations penetrate cleanly through the web with the web remaining substantially perpendicular to the plane of the knife. To enhance this perpendicularity, the width of the shelf slot is kept to a minimum so that there is minimum tendency of the web to be deflected downwards into the shelf slot by the edge of the knife. Resultantly, the web is severed cleanly from edge to edge.

As soon as the cover is released, it swings upward to some extent due to the bowed resilient knife sheath and may be swung upward to an open position, thereby releasing completely the rear edge margin of the severed web length which can then be draped around the article to be wrapped. The new leading edge of the web rests on the rear edge of th shelf so that it is readily accessible when a new length of web is required.

It is important to note that, in order for the dispenser to sever the web, particularly the very limp types of film, reliably from edge to edge, the knife sheath should be bowed downwardly so that the web is first engaged by the midportion of the sheath and then by sheath segments progressively further out on each side of that midportion until the sheath ends clamp the edges of the web against the dispenser shelf. At this point, the knife edge can cut the web cleanly and reliably. Apparently the superior cutting action is achieved because the progressive clamping action of the knife sheath causes the web to be tensioned laterally from edge to edge so that it is more receptive to being completely severed by the knife blade.

In other words, in dispensers of this general type, the web is tensioned somewhat in the longitudinal direction upon being pulled from the roll over the dispenser cutting shelf. However, no attempt has been made to tension the web in the lateral direction parallel to the knife edge. Resultantly, in many instances, the prior dispensers fail to cut the web completely from edge to edge. Rather, at some point or points across the sheet, the knife simply pushes the web down into the slot in the cutting shelf. This phenomenon occurs most often near or at the side edges of the web. In the present dispenser, however, the rolling clamping action of the knife sheath on the web seems to tension the web laterally. Therefore, the knife is able to consistently cut even very thin limp film across its entire width from edge to edge.

The dispenser includes provision for releasably locking the cover in its closed position to protect the web therein and to minimize the chance of injury to an inquisitive child. Also suction cups are provided at the underside of the dispenser so that it can be removably anchored to any suitable flat surface in the kitchen such as a countertop and thus be readily accessible to the user. The dispenser has a very neat trim exterior appearance and a relatively low profile. Further, it occupies a minimum amount of space in the kitchen and actually adds to the kitchen decor.

Even with the aforesaid advantages, the present dispenser is composed of a relatively few parts which are for the most part molded of a suitable impact-resistant plastic material. Therefore, the dispenser is relatively inexpensive to manufacture and assemble in quantity. Accordingly, it should find widespread use wherever there is a need for wrapping products, particularly food products in film, foil, wax paper and other webs of that general type.

BRIEF DESCRIPTION OF THE DRAWINGS

For a fuller understanding of the nature and objects of the invention, reference should be had to the following detailed description, taken in connection with the accompanying drawings, in which.

DESCRIPTION OF THE PREFERRED EMBODIMENTS

Figure 1:
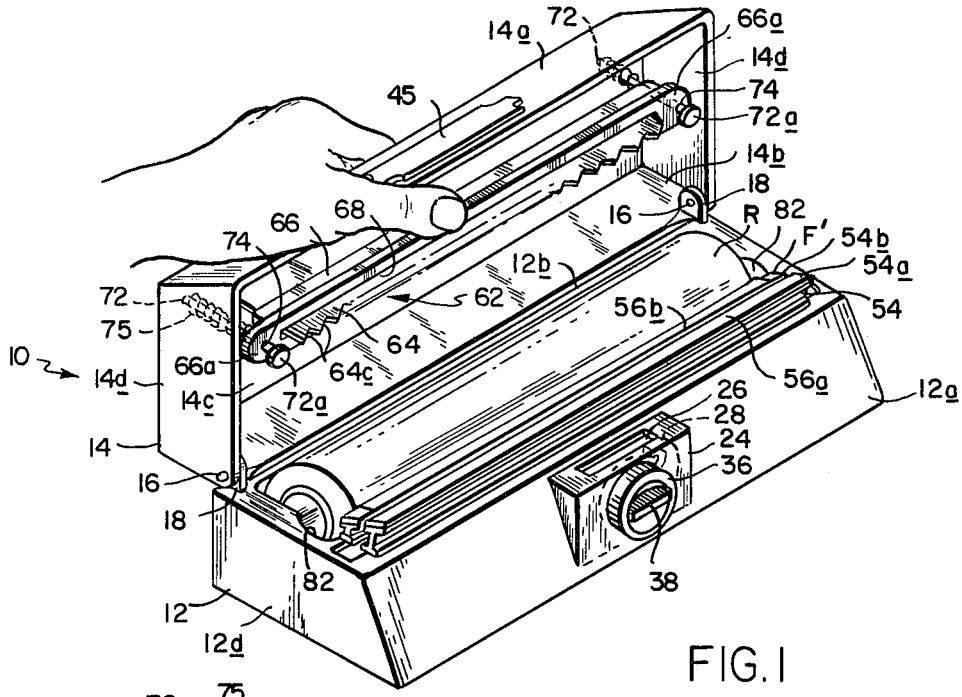
FIG. 1 is a perspective view of a dispenser embodying the principles of this invention showing the dispenser cover in an unusually wide open position with its knife sheath in a partially retracted position exposing the dispenser web cutting blade.
Figure 3:
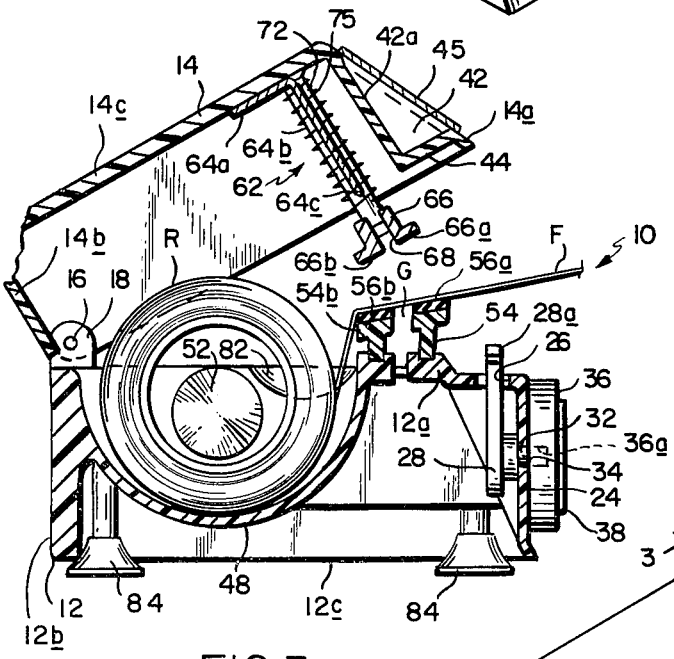
FIG. 3 is a sectional view on a larger scale along line 3—3 of FIG. 2.
Figure 2:
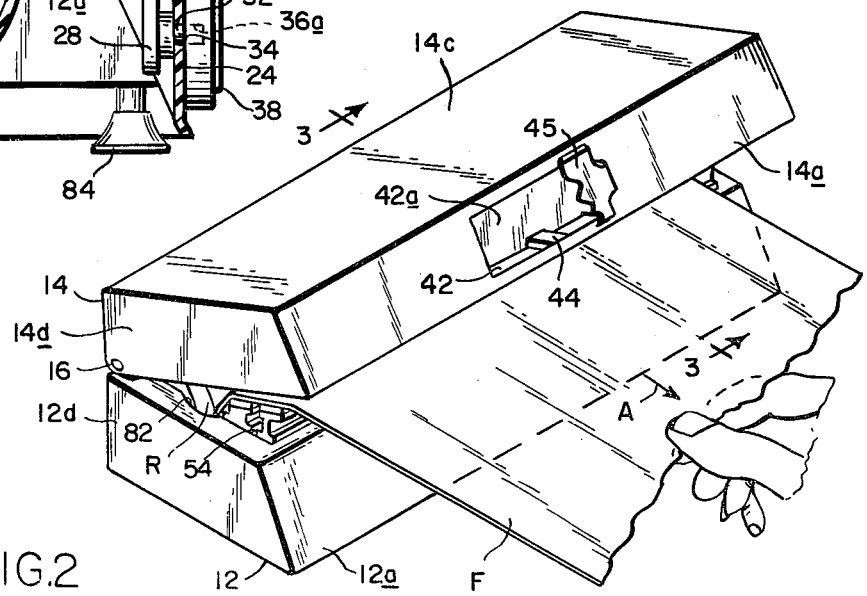
FIG. 2 is a perspective view of the FIG. 1 dispenser serving up a length of web.

Referring to FIGS. 1 to 3 of the drawings, a dispenser indicated generally at 10 comprises a generally rectangular open-top container 12 having a front wall 12*a*, a rear wall 12*b*, a bottom wall 12*c* and a pair of end walls 12*d*. Front wall 12*a* is angled rearwardly primarily for aesthetic reasons.

A cover 14 having a front wall 14*a*, a rear wall 14*b*, a top wall 14*c* and a pair of end walls 14*d* is hinged to container 12. More particularly, the lower rear corners of the cover end walls 14*b* are pivotally connected by rivets 16 to ears 18 projecting up from the rear corners of container 12. When the cover section is closed, the cover overhangs container 12 and the cover front wall 14*b* lies more or less parallel to the lower section front wall 12*a*. The cover 14 has a stable open position illustrated in FIG. 1. If desired, it may be biased to an open position by a spring (not shown) acting between the container 12 and cover 14. The cover can be pushed down to a fully closed position illustrated in FIG. 6 wherein it effectively closes the top of that container.

As shown in FIGS. 1 to 3, a latch is provided at the front of the dispenser 10 for releasably locking cover 14 in its fully closed position. More particularly, a wedge-shaped niche 24 having a lateral slot 26 in its top wall is formed at the center of the container front wall 12*a*. Inserted into the niche 24 from below is a latch 28 having a laterally extending post 32 which projects through an opening 34 in the front wall of niche 24 and engages in a opening 36*a* of a knob 36 positioned flush against the niche 24. The post and opening are noncylindrical and the post is pressfit into the opening 36*a* or adhesively secured therein as desired.

In any event, the latch and knob are rotatively coupled together and can be turned relative to container 12 so that the latch 28 can be swung between a retracted position shown in FIG. 1 wherein its hook 28*a* lies entirely within niche 24 and an extended position illustrated in FIG. 2 wherein hook 28*a* projects out more or less vertically through slot 26. A rib 38 molded into knob 36 apprises the user of the position of the latch 28. When the bar is horizontal as shown in FIG. 1, the latch is in its unlocked retracted position. On the other hand, when the bar is vertical as shown in FIG. 3, the latch is in its extended locking position.

The latch strike is molded into the front wall of cover 14 directly above niche 24. More particularly, a wedge-shaped recess 42 is formed in cover wall 14*a*. The bottom of recess 42 or opens into the interior of cover 14 except that a relatively narrow strap 44 extends between the cover front wall 14*a* and the recess rear wall 42*a*. When the cover 14 is in its closed position shown in FIG. 6, and the knob 36 is rotated counterclockwise to its position shown in FIG. 3, the latchhook 28*a* engages over strap 44 thereby releasably locking the cover in that closed position. On the other hand, when the knob 36 is turned clockwise to the position illustrated in FIG. 1, latch 28 is disengaged from strap 44 with the result that the cover can swing up to its open position shown in FIGS. 2 and 3. A plate 45 (FIGS. 1 and 2) may be attached to cover wall 14*a* to cover recess 42.

Obviously other latch arrangements can be used to releasably lock the cover in its closed position. The one specifically illustrated has proven to be advantageous because it is rugged and easy to assemble and cannot be operated in a manner to damage the latching mechanism.

As best seen in FIGS. 1 and 3, container 12 is formed with a semicylindrical trough 48 at the rear of the container which is sized to support a standard roll R of web material F such as plastic film. One standard size roll is 12 inches long and, when full, has a diameter of about 2 inches. Of course, the dispenser 10 can accommodate any roll which is shorter and/or has a smaller diameter. Also, the dispenser can be dimensioned to accommodate any available web roll without departing from the scope of the invention. Preferably, roll R is placed in the trough 48 so that the web is drawn from the underside of the roll as shown in FIG. 3. This prevents the roll from being pulled out of the trough as the web is drawn. Also, if desired and as shown in FIG. 1, bosses 52 or the equivalent can be formed in the interior surfaces of container end walls 12*d* which project somewhat into the ends of roll R to rotatively retain the roll in the trough 48.

As best seen in FIGS. 1 and 3, a shelf or ledge 54 is formed at the front of the container 12 at the top thereof. Shelf 54 is actually composed of two sections, namely a forward section 54*a* which projects up from the container front wall 12*a* and a rear section 54*b* which projects up from the forward edge of trough 48, the two shelf sections being separated along their entire lengths by a long knife-receiving gap G. The shelf sections are angled downwardly-rearwardly as best seen in FIG. 2. Also the top surfaces of shelf sections 54*a* and 54*b* are treated to give them a relatively high coefficient of friction. In the illustrated embodiment, a pair of long resilient pads 56*a* and 56*b* made of rubber, plastic or other comparable resilient material are adhered to the shelf sections 54*a* and 54*b*. The opposing edges of these strips define the width of the gap G. Alternatively, the top surfaces of the shelf sections themselves can be formed with knurls or ridges to roughen them.

Referring now to FIGS. 1 and 3, a cutting assembly indicated generally at 62 is mounted in cover 14 adjacent its front wall 14*a*. The cutting assembly includes a knife 64. The knife may be made of a rigid plastic formed separately from or integral with cover 14 or of a length of strong corrosion resistant metal such as stainless steel. The illustrated knife is generally L-shaped in cross section. Its short leg 64*a* lies flush against the inner surface of cover top wall 14*c* and is retained there by a strong cement, a heat weld or suitable fastening means. The long knife leg or blade 64*b* projects down from the cover toward section 12, terminating in a serrated edge 64*c*.

Enveloping the knife blade 64*b* is a retractable protective sheath 66 having a slot 68 into which the knife blade projects. The sheath is generally T-shaped in cross section as best seen in FIG. 3, with the slot 68 extending through the leg of the T at the junction of the arms thereof. Furthermore, the sheath is flexible and resilient and downwardly bowed. The sheath is engaged under the blade 64*b* and retained there by a pair of posts 72 attached to and projecting down from cover top wall 14*c* just beyond the ends of the blade. The posts 72 extend through holes 74 formed in tabs 66*a* projecting laterally from opposite ends of the sheath 66 and the sheath tabs are captured on the posts by heads or caps 72*a* present at the lower ends of the posts. A pair of coiled compression springs 75 on posts 72 bias the sheath to its extended position wherein its tabs 66*a* engage heads 72*a* so that the sheath completely envelops and protectively encloses the blade edge 64*c*. The sheath 66 is retractable in opposition to the spring bias so that the blade 64*c* projects through the sheath slot 68 so as to expose the blade edge 64*c* when the cover 14 is closed and the dispenser is in the process of cutting the web F drawn from roll R as will be described presently.

In order to use the dispenser 10, one first draws the web F from roll R over the shelf 54 in the direction shown by arrow A in FIG. 2. As noted previously, the film is drawn from the bottom of the roll so that the roll does not pull out of trough 48. Yet the engagement of the roll against the trough wall exerts a drag on the roll and ensures that the web pulls from the roll without wrinkling to any appreciable degree, even when only one hand is used to pull the web. If the web is a very thin limp film, it tends to cling to the resilient pads 56*a* and 56*b* or to the knurled shelf top sufaces on opposite sides of the gap G so that the web segment spanning the gap is tensioned somewhat in the pulling or longitudinal direction.

Figure 4:
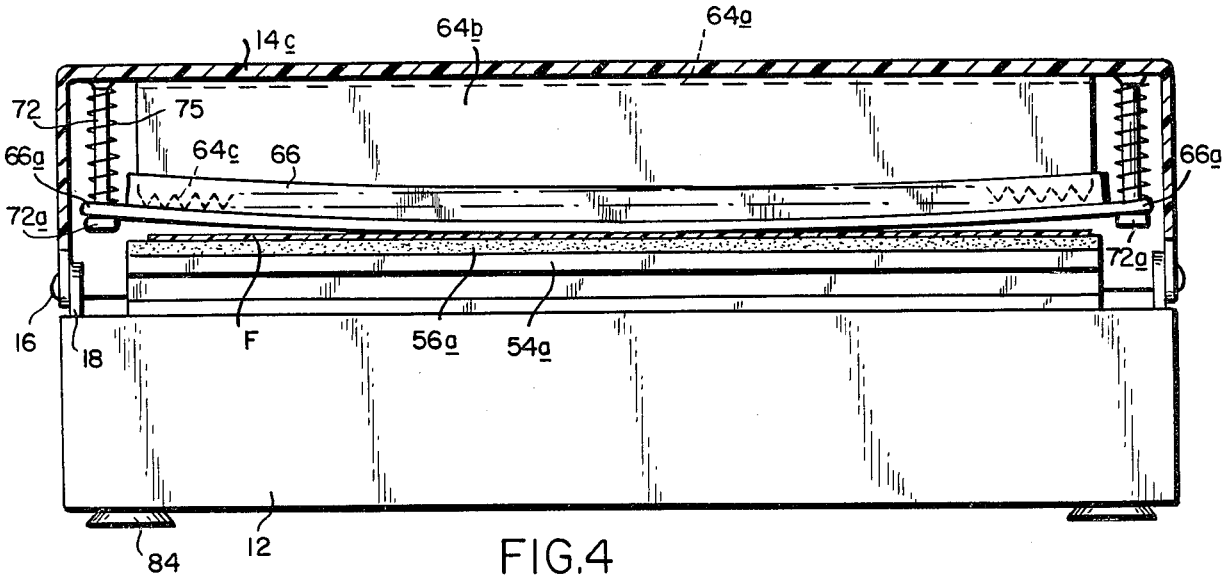
FIG. 4 is a front elevational view of the dispenser with parts broken away and with the cover in a partially closed position.

When the desired length of web F has been drawn, the user presses down on the cover 14 to swing it toward its closed position. As shown in FIG. 4, the bowed sheath 66 first engages the web F midway between the side edges of the web. The sheath section forward of slot 68 clamps against the forward shelf surfaces while the sheath section aft of the slot clamps against the aft shelf surface, thereby capturing that portion of the web on opposite sides of the gap G. The surfaces of shelf 54 are tilted or slanted to match the angle of the sheath undersurfaces.

Figure 5:
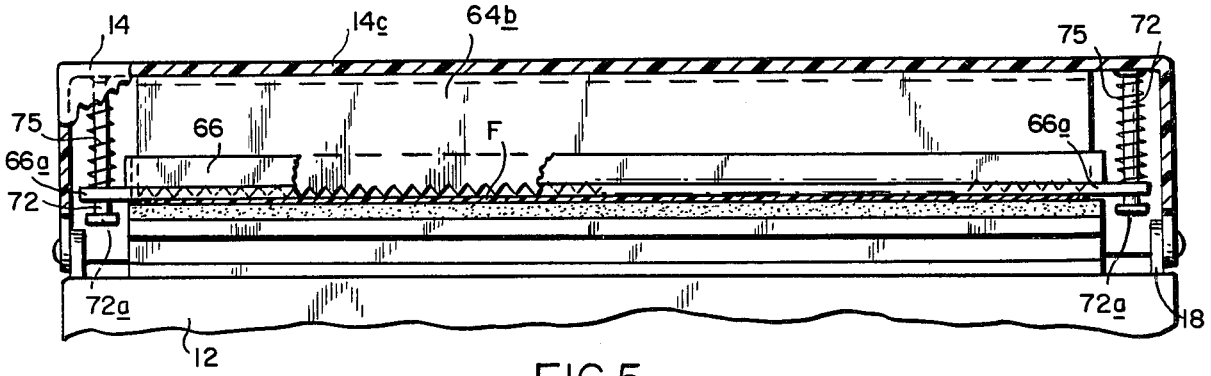
FIG. 5 is a fragmentary sectional view thereof showing the cover swung further toward its fully closed position.
Figure 7:
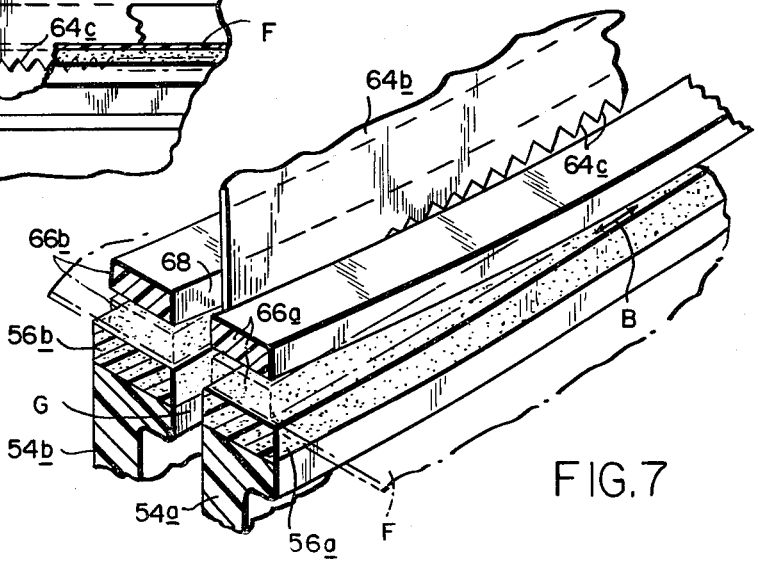
FIG. 7 is a fragmentary perspective view on a much larger scale further illustrating the operation of the FIG. 1 dispenser.

Further downward pressure on the cover 14 coupled with the sheath's engagement with the shelf (or the web F thereon) causes a progressive flexing of the sheath as shown in FIGS. 5 and 7 so that portions thereof further outboard from the sheath center line progressively clamp the web against the shelf. Thus the bowed sheath engages the web by a lateral rolling clamping action which progresses from the web center line toward the edges thereof until the entire length of sheath is pressed flat against the shelf as shown in FIG. 7. This apparently causes a lateral tensioning of the web from its longitudinal center line toward its side edges as shown by the two headed arrow B in FIG. 7 which makes the web very receptive to being cut.

Figure 6:
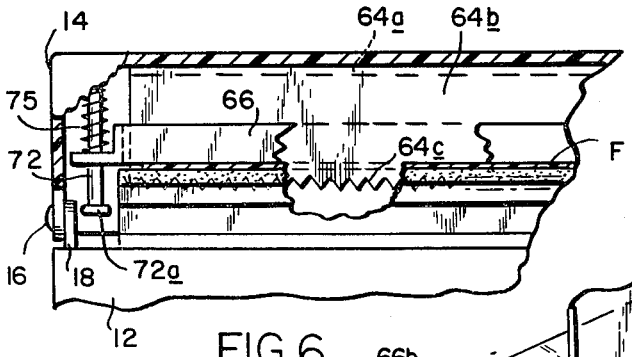
FIG. 6 is a similar view with the cover in its fully closed position.

Still more downward pressure on cover 14 causes the knife sheath 66 to retract toward the cover, thereby exposing the serrated blade edge 64*c* at slot 68. That edge thereupon projects through the web F down into the shelf gap G as shown in FIG. 6. Since the web is gripped on both sides of the gap G and is laterally tensioned by the rolling clamping action of the knife sheath, the blade edge cuts cleanly through the web along the entire width of the web. The cover 14 can then be released. The resilient sheath returns to its natural bowed shape, thereby raising the cover 14 to its position shown in FIG. 4, thereby unclamping the web. If the dispenser includes a spring, the cover swings open automatically. Otherwise, the cover may be lifted by hand. In any event, the severed length of web can be pulled out of the dispenser and used to wrap food or used otherwise.

The new web leading edge F′ (FIG. 1) remains clinging to the rear pad 56*b* so that it can be gripped by the fingers when a new length of web is required. Preferably, as best shown in FIG. 1, interior notches or recesses 82 are formed in the container side walls 12*d* at the tops thereof just behind shelf 54 to facilitate gripping the new leading edge of the web and drawing it out of the dispenser. More particularly, the user can insert fingers into those recesses to grasp the new web leading edge F′.

In a preferred embodiment of the dispenser, suction cups 84 are mounted to the underside of container 12 to anchor the dispenser to a countertop or other flat nonporous surface so that the dispenser will remain in place as web is being drawn from it.

It can be seen from the foregoing then that the illustrated dispenser 10 is particularly suitable for serving up and severing selected lengths of web and especially limp film used for packaging food which is characterized by a considerable amount of cling. The dispenser is composed for the most part of a relatively few molded plastic parts which can be manufactured in quantity relatively inexpensively. Moreover, the components of the dispenser can be assembled relatively easily. Therefore, the dispenser as a whole is quite easy and inexpensive to fabricate.

The dispenser cuts even very limp film completely and consistently and protects the user from potential injury from the dispenser's knife blade. Therefore, it should find wide application wherever film and other webs of selected lengths are needed.

It will thus be seen that the objects set forth above, among those made apparent from the preceding description, are efficiently attained, and, since certain changes may be made in in the above construction without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. In a web dispenser of the type having a roll container, means in the container for rotatively supporting a web roll, a swing-down cover hinged to the container, shelf means positioned just inside the front wall of the container extending substantially the entire length thereof, a long lateral gap formed in the shelf, a knife blade mounted in the cover adjacent the front wall thereof, said knife blade extending parallel to said gap and being of commensurate length, and a retractable sheath engaged under the knife blade, said sheath being movable between an extended position wherein it conceals the knife blade edge and a retracted position wherein it exposes said edge, characterized in that the sheath is constructed of a flexible resilient material and is downwardly bowed so that, when the cover is swung down toward said container, the sheath engages the shelf at the midportion thereof and then flexes so that it engages the shelf at points therealong progressively further away from the midportion by a rolling clamping action until, when the cover is almost fully closed, the sheath engages the shelf along substantially its entire length and is urged thereby to its retracted position whereby the blade edge projects into the shelf gap after cutting any web draped across the shelf.

2. The dispenser defined in claim 1 wherein the shelf is angled rearwardly and downwardly so that, when the cover is in its closed position, the sheath and shelf lie flush against one another.

3. The dispenser defined in claim 1 and further including resilient means mounted to one of said shelf and sheath said resilient means being positioned so that, when the cover is in its closed position, the resilient means are clamped between the sheath and shelf on opposite sides of the shelf gap.

4. The dispenser defined in claim 3 wherein the resilient means comprise elongated resilient pads adhered to the shelf on opposite sides of said gap.

5. The dispenser defined in claim 1 wherein the top surfaces of the shelf are roughened to increase their coefficient of friction.

6. The dispenser defined in claim 1 wherein said blade edge is serrated.

7. The dispenser defined in claim 1 and further including means for biasing the cover toward an open position wherein the knife blade is spaced above said shelf.

8. The dispenser defined in claim 1 wherein the shelf and sheath include substantially flat surfaces which engage one another on opposite sides of the shelf gap when the cover is moved to its closed position, thereby clamping web on the shelf between them so that the web is tensioned longitudinally as the knife blade cuts the web.

9. The dispenser defined in claim 1 and further including means for rotatively retaining a web roll in the container supporting means.

10. The dispenser defined in claim 1 and further including means attached to the underside of the container for removably anchoring the dispenser to a surface.

11. The dispenser defined in claim 10 wherein the anchoring means comprise suction cups.

12. The dispenser defined in claim 1 and further including coacting means on the cover and container for releasably locking the cover in its fully closed position.

* * * * *